US005707296A

United States Patent [19]

Hodgson et al.

[11] Patent Number: 5,707,296

[45] Date of Patent: Jan. 13, 1998

[54] TRAINING PUTTER WITH LASER LINE ALIGNMENT SYSTEM

[76] Inventors: Fred S. Hodgson, 224 Cardamon Dr., Edgewater, Md. 21037; John S. Fedor, 3118 Catrina La., Annapolis, Md. 21403

[21] Appl. No.: 738,904

[22] Filed: Oct. 28, 1996

[51] Int. Cl.[6] ..... A63B 69/36

[52] U.S. Cl. ..... 473/220; 473/253

[58] Field of Search ..... 473/220, 253, 473/254, 252

[56] References Cited

U.S. PATENT DOCUMENTS

| | | | |
|---|---|---|---|
| 5,029,868 | 7/1991 | Cloud | 473/220 |
| 5,165,691 | 11/1992 | Cook | 473/220 |
| 5,207,429 | 5/1993 | Walmsley et al. | 473/220 |
| 5,527,041 | 6/1996 | Terry | 473/220 X |
| 5,593,354 | 1/1997 | Falossi et al. | 473/220 |

*Primary Examiner*—George J. Marlo
*Attorney, Agent, or Firm*—Aquilino & Welsh

[57] ABSTRACT

A putter including a club head, a shaft, a handle, a ball striking face, a heel, a toe, and an upper surface, with the shaft being connected to the upper surface, and a pair of light sources located in the ball striking face.

One light source is located adjacent to the heel and other light source is located adjacent the toe. Also, included in the putter is a power source for energizing the light sources;

a switch for connecting the light sources to the power source; and, an optical device associated with each of the light sources for focusing a light beam from said light sources, when the light sources are energized, into a continuous, visible linear image of light in the form of a persistent, visual pair of alignment lines on a putting surface. The pair of alignment lines extend forwardly of and perpendicular to the striking face from a point on the putting surface adjacent the ball striking face towards a remote target, said image being formed at each side of a golf ball when the putter head is in place behind the ball prior to and during the execution of a putting stroke.

9 Claims, 5 Drawing Sheets

TRAINING PUTTER WITH LASER LINE ALIGNMENT SYSTEM

BACKGROUND AND SUMMARY OF THE INVENTION

The present invention relates to training putters and in particular to a training putter using a laser alignment system.

There are a number of variables which determine whether a golf ball hit by a putter will traverse an intervening distance and go into a hole. Three primary variables are; the speed at which the ball is struck; the swing path, that is the direction in which the putter head travels relative to the target; and, the putter face angle. Other variables which may effect the putting stroke include the speed and condition of the putting surface and environmental conditions, however the golfer has no control over these. Most makeable putts, that is putts from within 15 to 20 feet and less are missed because the club face angle is not properly aimed or the swing path of the putter head is not in a proper direction.

There are many training devices available for use by a golfer to address these problems. However, most training devices require separate attachments or other apparatus, used in combination with the putter head, to provide feed back to the golfer when the club head is mis-aligned or not swung properly during the execution of a putting stroke. Examples of training devices are pointers attached to the club head, track devices in which the putter is swung and electronic devices which monitor and record the location of the club head at various points along the swing path.

Prior art patents for training a golfer to develop a putting stroke using light sources are well known in the art. For example, the patent to Rabold (U.S. Pat. No. 4,971,327) describes a putter in which a set of three lights is located in the bottom of the club head pointing downwardly. The lights indicate the position of the club as a ball is struck, however, the golfer is forced to take his eyes off of the ball and to concentrate on the lights in order to determine the tracking direction. When the club is positioned directly behind the ball, prior to the beginning of a putting stroke, the golfer is unable to see any of the lights.

The patent to Cloud (U.S. Pat. No. 5,029,868) relates to a putter type golf club aiming system using a laser located in the handle which is connected to the club face with fiber-optics to create a pair of light beams which are reflected onto a target with a reflective surface. The device is useful only in the aiming portion of the stroke and depends upon the use of the reflective target to provide feedback to the golfer. This requires the golfer to look at the back drop in order to determine if the club is aimed properly. The device can not be used while the stroke is actually being made because it would require the golfer to look at the back drop and thereby take his eyes off of the ball which is unacceptable in creating a good stroke.

The Tindale patent (U.S. Pat. No. 5,169,150) relates to a single laser aiming device which uses a graduated back drop. The golfer aims the putter at the target and then visually determines the offset between the target line and the line which has been taken. The patent teaches that the offset must be inscribed on the top edge of the putter to be effective and deals with alignment only, and not the stroke itself.

The Reimers et al patent (U.S. Pat. No. 5,324,039) discloses another aiming device which requires an emitter located in a target which sends signals to a receiver in the putter head. This complex design requires two independent components, the emitter being located remote to the putter head.

The patent to Hendrickson (U.S. Pat. No. 5,193,812) shows a golf club with an aiming device which is attached to the top of the club head which projects a single light beam that is parallel to the ground. The device requires a complex attachment mechanism to support a laser emitter centrally above the ball. At best, the device serves to improve the aiming of the putting stroke. There is no feed back provided to the golfer to assist in the stroke process. Additionally, the added mechanism totally changes the swing characteristics of the putter to which it is attached, requiring a golfer to practice with a different implement than the one he actually plays with.

The Avanzini patent (U.S. Pat. No. 5,213,331) discloses another aiming device using a laser assembly mounted in an adjustable fixture which is positioned over the ball. The device creates a single spot on the grass at some point in front of the ball. The spot moves as the club is used to strike the ball at such a speed making it of practically no value requiring that a golfer would have to take his eye off of the ball to observe the rapidly moving spot.

The DeAguilar patent (U.S. Pat. No. 5,217,228) is directed to an aiming device which depends upon the projection of a light through a slot in the handle of the putter. This design provides an awkward geometry to create a point on the ground in front of the shaft which is off-set from a line the ball would take when stroked by the club to the target.

The Nelson patent (U.S. Pat. No. 3,953,034) shows an aiming device which uses a mirror in the head of the club and a laser light attached to the outside of the club handle. This systems requires a mounting of the laser on the shaft, creating an unnecessary attachment means and a complex optics system using a convex mirror to spread the laser beam to project a line.

The Harnberg patent (U.S. Pat. No. 5,082,282) relates to a swing path diagnostic tool using two light emitters, one aimed at the target, and the other aimed at the ground direct under the club head. The beams are used for grooving the swing, however, the path that the light projects onto the ground cannot be observed by the golfer without taking his eye off of the ball. Furthermore, the device is specifically used for a driver-type golf club head rather than a putter.

The patent to Cook (U.S. Pat. No. 5,165,691) is directed to a swing development tool which uses two lasers which requires the use of special laser glasses to see the beam. Furthermore, the beams are not visible without a back drop or without manipulating the club head so that it points downwardly toward the ground.

The present invention relates to a putter type training device which is entirely self contained in the putter structure and which requires no extra equipment such as reflection boards, guide paths, tracks, light or sound emitters, special glasses, auxiliary power supplies or any other attachments and/or accessories. The device of the present invention provides feedback to train a golfer not only when it is used to determine the alignment position of the putter head at address, before a ball is struck, but also during a stroke by enabling a golfer to visually see the track or path of the putter head as it moves.

By being self contained in the putter itself, the training device allows a golfer to focus his eyes on the ball throughout the swing since the laser lines which create the visual tracks remain adjacent to the ball. The training device may be sized and weighted to be fully compatible with conventional putters not having the training system, and therefore the putter may be used for actual play on a golf course by virtue of a size, weight and feel of the putter being consistent with a conventional putter. The training device may be used at any location where a putting surface is available, either indoors or outdoors. It will be appreciated that the device works more efficiently in low-level light conditions, such as is found indoors or in shaded areas, rather than outdoors in bright sunlight. Because the present invention is self-contained, there is no necessity for complementary apparatus to be used and therefore, a golfer's location may be continuously changed when using the device. For example, when the golf uses the training device on a putting green, he is able to aim at any hole or target from any direction, thereby providing a wide variety of putting experiences in the same manner as if he were using a club without the training device.

The training device of the present invention is defined by a pair of light emitting laser light sources combined with a suitable optics to create a pair of parallel lines on a putting surface, up to four feet in front of the ball, creating a path or track which the golfer may use to visualize the proper path a ball must traverse to the target. The lasers are mounted within recesses in toe and heel portions of the ball striking face so that the light beams are perpendicular thereto. The lasers are attached in a circuit to suitable on/off switches and a battery power source preferably located in the handle of the club. The lasers, wires and other electrical equipment are totally contained within the club itself, requiring no additional equipment or attachments which greatly simplifies the training process enabling the device to be used any where and any time a suitable putting surface is available.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
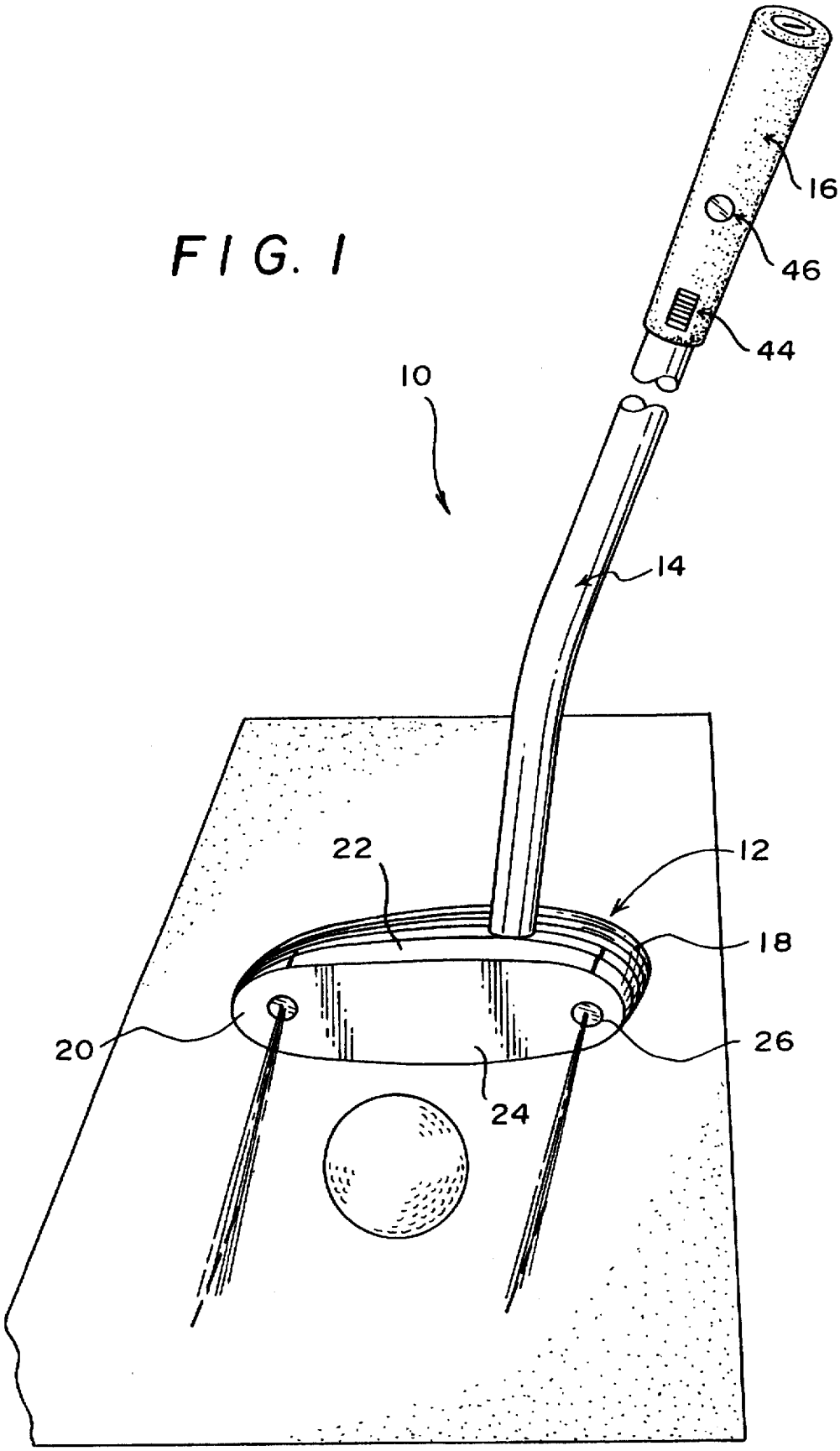
FIG. 1 is a perspective view of the putter type golf club of the present invention.
Figure 2:
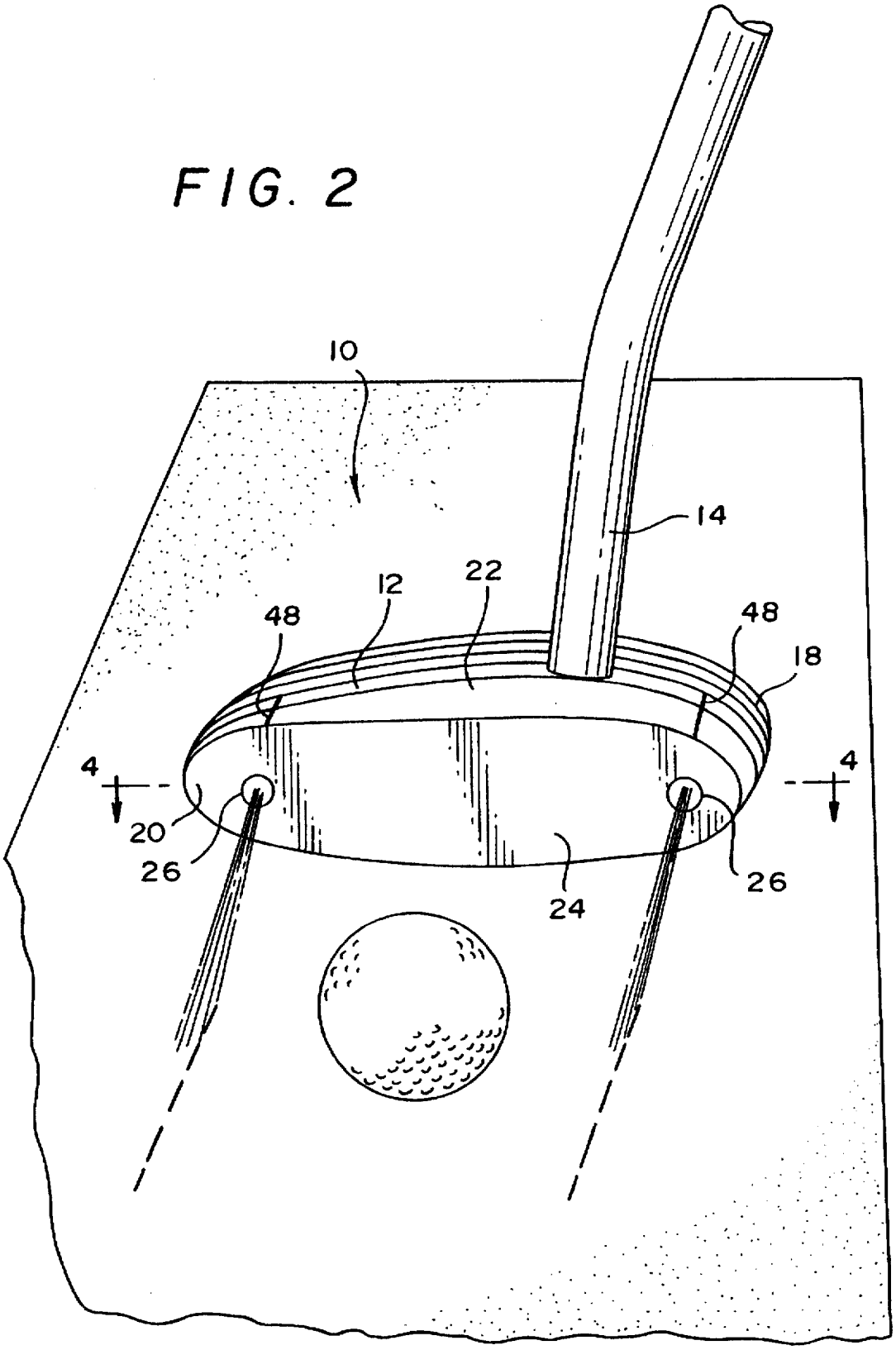
FIG. 2 is a perspective view of the golf club putter head of FIG. 1.
Figure 3:
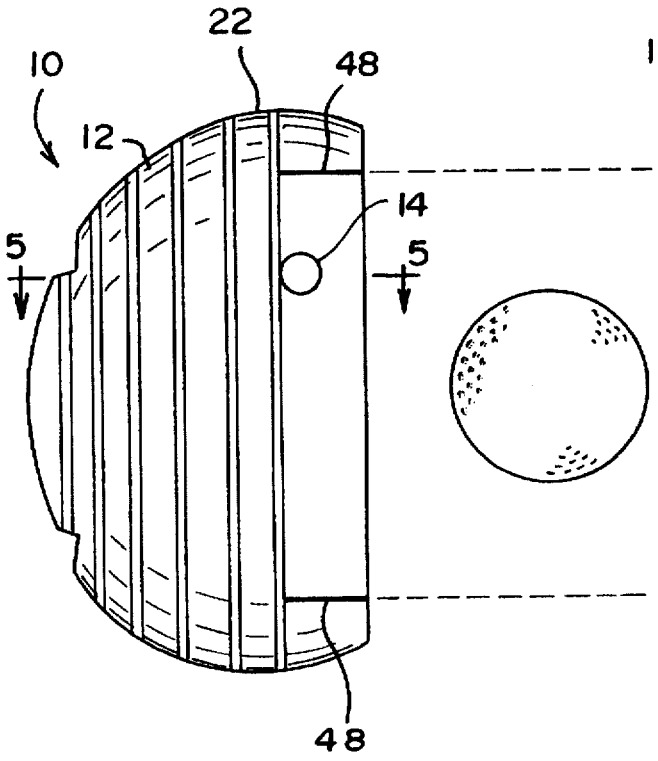
FIG. 3 is a top plan view of the putter head of the golf club of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, A putter type golf club 10 in accordance with the present invention, includes a putter head 12, a shaft 14 and a handle 16. The putter head 12 includes a heel 18, toe 20, an upper surface 22, and a ball striking face 24.

The putter head 12 includes a pair of laser light sources 26 located at on opposite ends of the ball striking face 24 adjacent the toe 20 and heel 18 of the putter head 12. The laser light sources 26 are laser diodes which are commercially available, for example, LD-3148-021,635 nm, Sanyo Semiconductor Corp. The laser diodes are placed in a cylindrical housing 28 which is fit into complementary openings 30 in the putter head 12 as seen in the sectional view of FIG. 4. A thin glass lens 32, having an outer surface even with the ball striking face 24 is inserted in front of the laser light sources 26 after they are placed in each opening 30. The laser optics include a lens 34 for focussing the laser beam and allowing the light beam to expand in one direction from a point to a 2.8 degree expanding fan creating a visible line in front of the ball striking face 24 onto a putting surface. These lines on the putting surface preferably are formed from 18 inches to 3 feet in front of the putter head and create a track-like image which is used to aim the putter at the target and which is used as a reference through which the ball is to be rolled.

It will be appreciated that a golfer may extend the lines further out toward the target, depending upon the lighting conditions, by upwardly tilting the face of the club head 12. The visibility of the beams in outdoor environments decreases depending upon the brightness level. Preferably each laser is a 635 nm wave length laser which produces light of the highest visibility to the human eye. Therefore the brighter the apparent light of the lines, the more useful the device becomes under outdoor conditions. Focusing the track lines at a two to three foot distance from the putter head, has been found to maximize the intensity of the lines. To achieve the line pattern, the openings 30 in the ball striking face 24 in which the laser light sources 26 are located, are drilled at an angle of two degrees and 35 minutes with respect to the horizontal for a putter having a lift angle of approximately three degrees. Putters that have higher degrees of lift may be adjusted accordingly.

Figure 8:
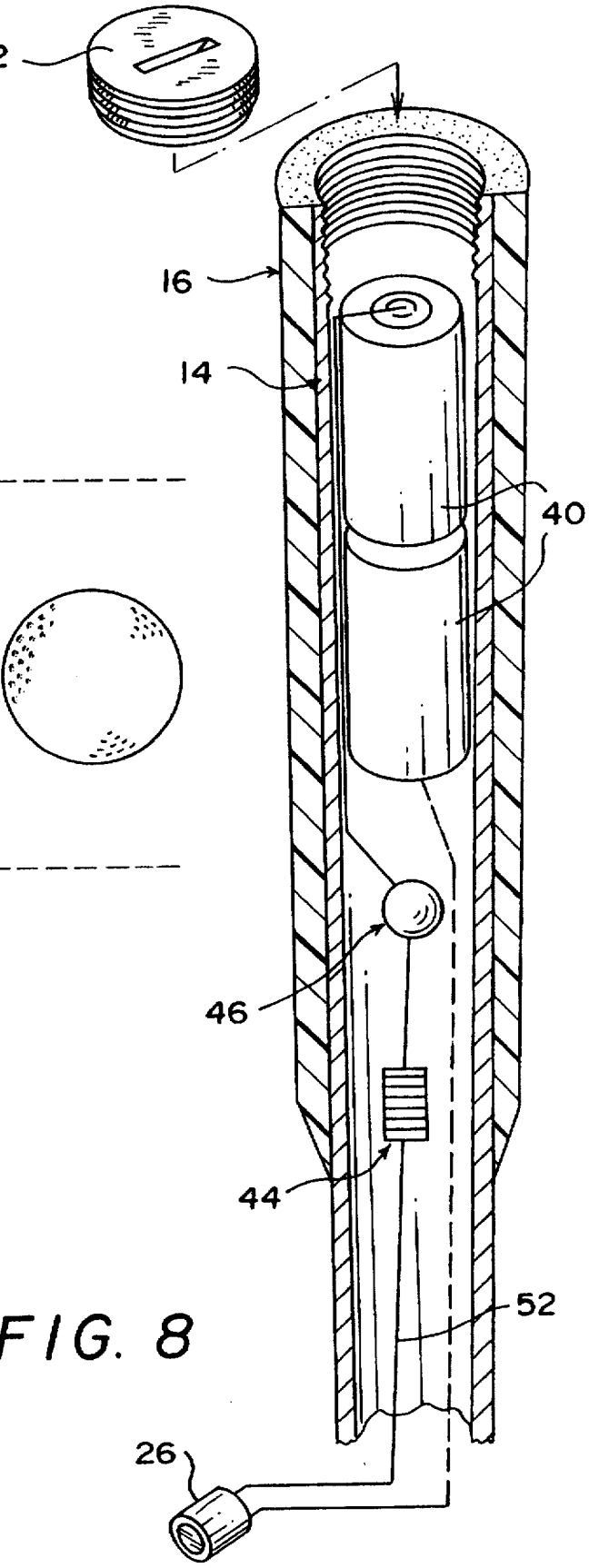
FIG. 8 is a sectional view of the handle section of golf club.

Referring to FIG. 8, a battery pack 40 is placed within the handle 16 and is accessible through a threaded cap 42 formed in the top of the handle 16. The handle 16 is provided with an on/off switch 44 and a pressure sensitive switch 46, connected in series, with the battery pack 40 and laser light sources 26, whereby a golfer is required to turn the on/off switch 44 to the "on" position and further to depress the pressure sensitive switch 46 in order to illuminate the laser light sources 26. It will be appreciated that the on/off switch 44 provides a measure of safety should the pressure sensitive switch 46 be accidentally actuated thereby preventing the occurrence of stray light beams which could adversely effect the golfer's vision.

Preferably, the putter 10 is provided with a pair of sighting lines 48, located on the upper surface 22 at the heel 18 and toe 20 which appear to be extensions of the track lines to a golfer viewing the putter head 12 from above whereby the golfer may use the sighting lines 48 to reinforce the training received when the laser light sources 26 are operational.

Figure 4:
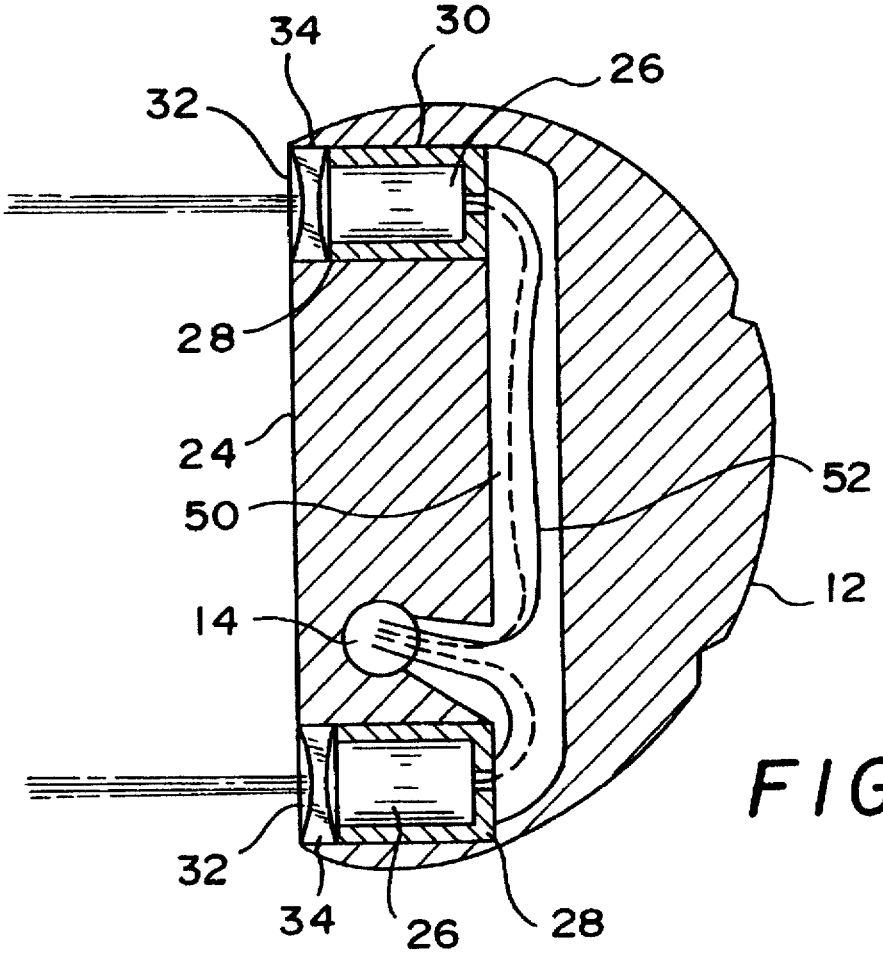
FIG. 4 is a sectional view taken along the line 4—4 of FIG. 2.
Figure 5:
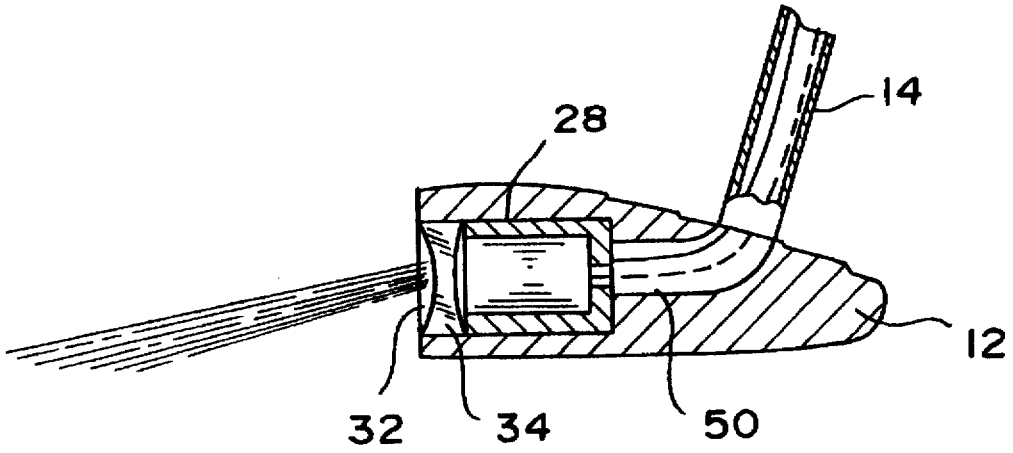
FIG. 5 is a sectional view taken along the line 5—5 of FIG. 3.

It will be appreciated that the shaft 14 of the golf club 10 extends directly into the upper surface 22 of the putter head 12 without going through a solid hosel. Referring to FIG. 4, a suitable channel 50 directs the wiring 52 from each laser light source 26 upwardly through the shaft 14 where the wiring 52 is connected to the power supply consisting of the battery pack 40 and switches 44 and 46 located in the handle 16.

Figure 6:
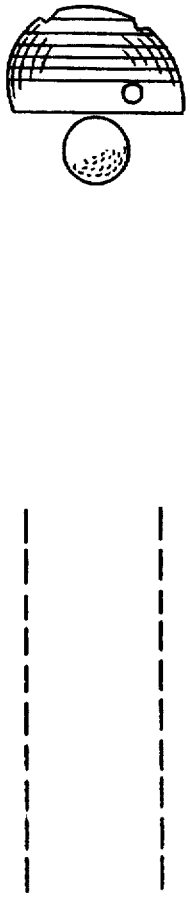
FIG. 6 is a pictorial view of the putter head and its relationship to a golf hole.
Figure 7:
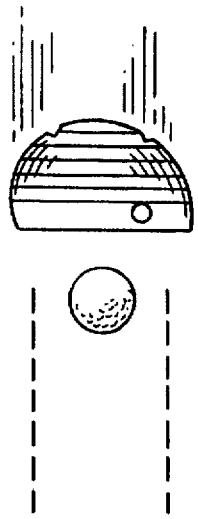
FIG. 7 is a pictorial view of the putter head and it relationship to the hole during the execution of a putting stroke.
Figure 7:
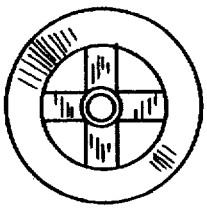
Figure 7:
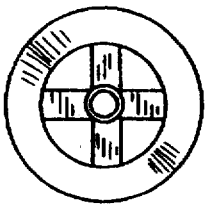

In use, a golfer turns the on/off switch 44 to the "on" position and aligns the putter head 12 behind a golf ball toward a target. Depressing the pressure sensitive switch 46 energizes the laser light sources 26 which create a pair of track lines forwardly of the ball striking face. By manipulating the position of the club head 12, the lines may be directed at the intended target. (See FIG. 6) The golfer is then assured that the club head 12, at least in the start position, is properly aligned toward the hole. When the putting stroke begins, the track lines move rearwardly and appear on either side of the stationary golf ball. Both during the back swing portion of the stroke and the initial forward swing, the track lines will be visible on either side of the ball without the need of the golfer's head to move to see the lines. (See FIG. 7). If the lines are not spaced equidistant from the golf ball, the golfer knows that the putter is not being brought back or moved forward in a straight line.

Thus, a golfer may use the putter of the present invention to; a) train himself to initially align the club head 12 precisely at the target and secondly; and b) to bring the putter head 12 back and forward on a straight line path by monitoring the position of the laser track lines. The golfer keeps the laser light sources 26 "on" throughout the swing by keeping the pressure sensitive switch 46 depressed. By concentrating on keeping the lines on the target throughout the swing, the golfer, through biofeedback, develops an ability to aim and strike the ball with greater accuracy.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A putter type golf club head including a club head, a shaft and a handle; said club head including a ball striking face, a heel, a toe, and an upper surface; said shaft being connected to said upper surface;

the improvement comprising:

a pair of light sources located in said ball striking face; one source being adjacent to said heel and other source being located adjacent said toe;

a power source for energizing said light sources;

switching means for connecting said light sources to said power source; and, optical means associated with each of said light sources for focusing a light beam from said light sources, when said light sources are energized, into a continuous, visible linear image of light in the form of a persistent, visual pair of alignment lines on a putting surface, said pair of alignment lines extending forwardly of and perpendicular to the ball striking face from a point on the putting surface adjacent said ball striking face toward a remote target; said image being formed at each side of a golf ball when the putter type club head is in place behind the ball prior to and during the execution of a putting stroke.

2. The putter of claim 1 wherein said light sources are light emitting laser diodes.

3. The putter of claim 1 wherein said power source and said switching means are located in said handle.

4. The putter of claim 1 wherein said switching means includes an on/off switch and a pressure sensitive switch in series with said light sources and said power source.

5. The putter of claim 1 wherein said putter head includes an opening in said heel and an opening in said toe, said openings sized to snugly fit said light sources therein.

6. The putter of claim 5 further including a channel in said club head in communication with an interior opening in said shaft for housing electrical leads connected between said light sources and said power supply.

7. A putter type golf club head including a club head, a shaft and a handle; said club head including a ball striking face, a heel, a toe, and an upper surface; said shaft being connected to said upper surface; the improvement comprising:

a pair of light sources located in said ball striking face; one source being adjacent to said heel and other source being located adjacent said toe;

a power source for energizing said light sources;

optical means associated with each of said light sources for focusing a light beam from said light sources, when said light sources are energized, into a continuous, visible linear image of light in the form of a persistent, visual pair of alignment lines on a putting surface, said pair of alignment lines extending forwardly of and perpendicular to the ball striking face from a point on the putting surface adjacent said ball striking face toward a remote target; said image being formed at each side of a golf ball when the putter type club head is in place behind the ball prior to and during the execution of a putting stroke;

and switching means for connecting said light sources to said power source, said switching means being located in said handle; said switching means including an on-off switch and a pressure sensitive switch in series with said on-off switch whereby said on-off switch and said pressure sensitive switch both are required to be in an on position to energize said light sources.

8. A putter type golf club head including a club head, a shaft and a handle; said club head including a ball striking face, a heel, a toe, and an upper surface; said shaft being connected to said upper surface; the improvement comprising:

a pair of light sources located in said ball striking face; one source being adjacent to said heel and other source being located adjacent said toe;

a power source in said shaft for energizing said light sources;

optical means associated with each of said light sources for focusing a light beam from said light sources, when said light sources are energized, into a continuous, visible linear image of light in the form of a persistent, visual pair of alignment lines on a putting surface, said pair of alignment lines extending forwardly of and perpendicular to the ball striking face from a point on the putting surface adjacent said ball striking face toward a remote target; said image being formed at each side of a golf ball when the putter type club head is in place behind the ball prior to and during the execution of a putting stroke;

switching means for connecting said light sources to said power source, said switching means being located in said handle; said switching means including an on-off switch and a pressure sensitive switch in series with said on-off switch whereby said on-off switch and said pressure sensitive switch both are required to be in an on position to energize said light sources;

said club head being further defined by an opening in said heel, an opening in said toe, said openings sized to snugly fit said light sources therein; and a channel connecting said openings; a shaft opening in said shaft; said channel and said shaft opening housing electrical leads between said light sources and said power source in said shaft.

9. The putter head of claim 1, 7 or 8 further including on said upper surface a pair of sighting lines located at the heel at toe which appear to a golfer to be extensions of said alignment lines when viewing the putter head from above.

* * * * *